United States Patent [19]

Ochiai et al.

[11] Patent Number: 4,522,040

[45] Date of Patent: Jun. 11, 1985

[54] REFRIGERATOR

[75] Inventors: Hideo Ochiai; Yoshinari Nagoya; Ryoichi Fujimoto; Susumu Yamazaki; Nobuhiko Sasamoto; Shinichi Ishida, all of Tochigi, Japan

[73] Assignee: Hitachi, Ltd., Tokyo, Japan

[21] Appl. No.: 532,894

[22] Filed: Sep. 16, 1983

[30] Foreign Application Priority Data

Sep. 17, 1982 [JP] Japan ..... 57-161002

[51] Int. Cl.[3] ..... F25D 17/06

[52] U.S. Cl. ..... 62/419; 62/441

[58] Field of Search ..... 62/440, 441, 452, 453, 62/456, 507, 454, 428, 419

[56] References Cited

U.S. PATENT DOCUMENTS

| | | | |
|---|---|---|---|
| 1,602,178 | 10/1926 | Spreen | 62/441 |
| 2,741,095 | 4/1956 | Jacobs | 62/441 X |
| 2,798,367 | 7/1957 | Earle | 62/441 X |
| 3,005,321 | 10/1961 | Devery | 62/441 X |
| 3,232,071 | 2/1966 | Wallenbrock et al. | 62/456 X |
| 3,307,365 | 3/1967 | Townsend | 62/419 X |
| 3,893,307 | 7/1975 | Jacobs | 62/441 X |
| 4,301,663 | 11/1981 | Hoshino | 62/453 |

*Primary Examiner*—Lloyd L. King

*Attorney, Agent, or Firm*—Antonelli, Terry & Wands

[57] ABSTRACT

A refrigerator has a machine chamber disposed in a bottom part of a refrigerator body, a cover for covering the machine chamber, upper heat discharge passages formed in side edge portions of a rear surface of the refrigerator body, lower heat discharge passages formed in offsetted portions of both sides of the machine chamber cover, and heat discharge ports provided in a wall of each of the lower heat discharge passages for providing a communication between the lower and the upper heat discharge passages. A main condenser of the refrigerator is mounted on a top of the refrigerator body and is covered by a decorative cover.

2 Claims, 11 Drawing Figures

REFRIGERATOR

BACKGROUND OF THE INVENTION

The present invention relates to a refrigerator having a compressor incorporated in a machine chamber disposed in a lower part of the refrigerator.

A typical conventional refrigerator of the type disclosed in, for example, Japanese Laid Open Application No. 158473/1980, as shown in FIGS. 1-3, a refrigerator is proposed which includes a refrigerator body 1, defining therein a chamber 20 including a freezing chamber portion and a refrigerating chamber portion with the freezing chamber portion including a freezing chamber door 2 and the refrigerating chamber including a refrigerating chamber door 3 respectively adapted to close a front opening formed in the chamber 20. An outer frame 4 defines a contour of the refrigerator body 1, with the outer frame 4 including a table panel 5, defining a ceiling surface, side panels 6,6, a rear panel 7, a bottom panel 8, and so on. The refrigerator further includes a compressor 9, a drain pan 10, and a condenser 11 for evaporating the drain collected in the drain pan 10. The compressor 9, the drain pan 10, and the condenser 11 are positioned within a machine chamber 12 disposed in a lower part of the refrigerator body 1. A main condenser pipe 13, as shown in FIG. 2, is closely attached to a decorative cover 14 which is utilized as a heat-radiating panel, with a rear cover 15 covering a rear portion of the machine chamber 12. The covers 14 aand 15 are attached to protrusion portions 16 formed on a rear of the refrigerator body 1 so that the covers 14, 15 substantially exist in the same plane. In this case, as shown in FIG. 1, between the rear panel 7 and the covers 14, 15 a heat discharge passage 17 is defined. Accordingly even if the refrigerator body 1 is placed in such a manner that a rear surface of the refrigerator body 1 comes in contact with a wall or the like, the heat discharge pasage is not impaired, so that an air heated through the heat exchange with the condenser 11 and the compressor 9 and a wet air having evaporated from the drain pan 10 as well as an air heated through the heat exchange with the main condenser pipe 13 are discharged to the outside through the heat discharge passage 17.

Accordingly, in a refrigerator of the type described above, a distance corresponding to the depthwise dimension $L_1$ of the heat discharge passage 17 must be kept from the rear panel 7 of the refrigerator body 1. Consequently, a depthwise dimension of a refrigerator is increased, so that it is difficult to decrease the dimension of the refrigerator. In addition, since the wide rear surface of the refrigerator body 1 is covered with the decorative cover 14, upon passing through the heat discharge passage 17, the high-temperature air heated through the heat exchange with the compressor 9 undesirably heats up the chamber 20 over a wide area to increase the amount of heat leakage into the chamber 20, so that it becomes difficult to reduce the power consumption of the refrigerator. Moreover, the necessity of the rear decorative cover 14 obliges the cost to be high.

SUMMARY OF THE INVENTION

A primary object of the invention is to provide a refrigerator improved to decrease a depthwise dimension as well as heat leakage amount, and a cost thereof.

In accordance with the invention, a refrigerator is provided having a substantially rectangular parallelepiped refrigerator body defining therein a chamber, a machine chamber disposed in a bottom part of the refrigerator body, a compressor disposed in the machine chamber, and a cover for covering a rear of the machine chamber, wherein the machine chamber cover is disposed so as to be substantially flush with a rear surface of the refrigerator body. Upper heat discharge passages are formed by cutting edge portions on both sides of the rear surface of the refrigerator body, with lower heat discharge passages being formed by providing offset portions on both sides of the cover of the machine chamber. Heat discharge ports are formed in a wall of each of the lower heat discharge passages for providing a communication between the upper and lower heat discharge passages; and upper end of each of the upper heat discharge passage is opened to an atmosphere.

According to the invention, the heat discharge passage for the heated air from the compressor are not projected beyond the rear surface of the refrigerator body. Therefore, the refrigerator can be made smaller in depthwise dimension than the prior art, thereby making it possible to reduce the required space. In addition, since it is unnecessary to cover the rear surface of the refrigerator body with the decorative cover, the production cost can be lowered. Moreover, the high-temperature air heated through the heat exchange with the compressor rises through the upper heat discharge paassage portion formed by cutting the edge portions on both sides of the rear surface of the refrigerator body and hence hardly heats up the chamber. Thus, it is possible to largely reduce the power consumption of the refrigerator.

The above and other objects, features and advantages of the invention will become apparent from the following description taken in connection with the accompanying drawings.

BRIEF DESCRIPTION OF THE DRAWINGS

Referring now to FIGS. 4 to 11, in accordance with the present invention, a refrigerator includes a refrigerator body 21 defining therein a chamber 22 including a freezing chamber portion and a refrigerating chamber portion respectively being adapted to be closed by a freezing chamber door 23 and a refrigerator chamber door 24. An outer frame 25, defining a contour of the refrigerator body 21 includes a ceiling panel 26, side panels 27,27, a rear panel 28, a bottom panel 29, and so on. A compressor 30 a drain pan 31 and a condenser 32 for forcedly evaporating the drain collected in the drain pan 31 are positioned within a machine chamber 33 disposed in a bottom part of the refrigerator body 21. Upper heat discharge passages 34 are respectively formed in the side edge portions of the rear panel 28, with the upper heat discharge passages 34 being defined by the rear panel 28 of dish-like shape having tapered grooves formed in both side edge portions over the entire length thereof. The reason why the heat discharge passages 34 are formed in these portions of the refrigerator is to utilize portions where the heat-insulating wall is thickest and hence there is no possibility of heat leakage into the chamber 22, as shown in FIG. 6.

A cover 35 covers the machine chamber 33, and lower heat discharge passages 36 formed on the cover 35, with heat discharge ports 37 being formed in a wall of the respective lower heat discharge passage 36. The lower heat discharge passages 36 are formed to have a width not less than that of the upper heat discharge passages 34. In this case, since the width of the upper heat discharge passages 34 is 50 mm, the lower heat discharge passages 36 must have a width larger than 50 mm. The width of the lower heat discharge passage 36 is selected in accordance with the amount of heat generated in the machine chamber 33. In addition, the cover 35 is attached to the refrigerator body 21 so that the cover 35 and the rear panel 28 substantially exist in the same plane. A main condenser 38 is mounted on the ceiling panel 26 and a decorative cover 39 is provided for covering the main condenser. As shown in FIG. 7, the decorative cover 39 includes a front cover portion 40, main cover portion 41 covering the main condenser 38, and a rear frame 42.

Figure 1:
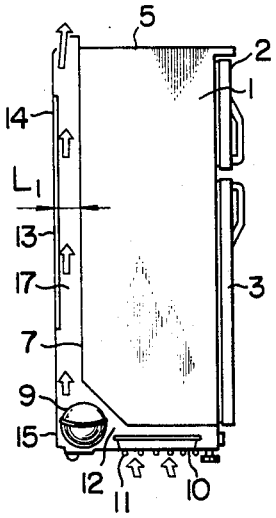
FIG. 1 PRIOR ART
FIG. 1 is a partially schematic side view of a prior art refrigerator apparatus.
Figure 2:
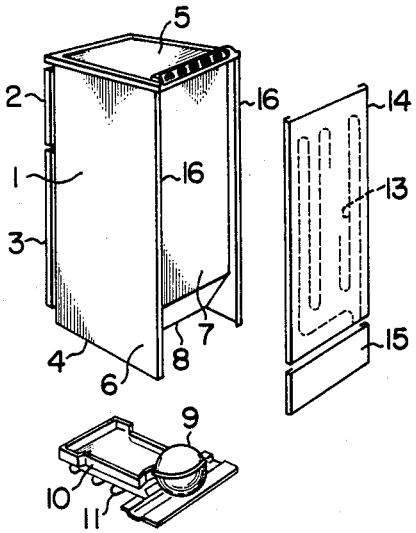
FIG. 2 PRIOR ART
FIG. 2 is an exploded view of the refrigerator apparatus of FIG. 1.
Figure 3:
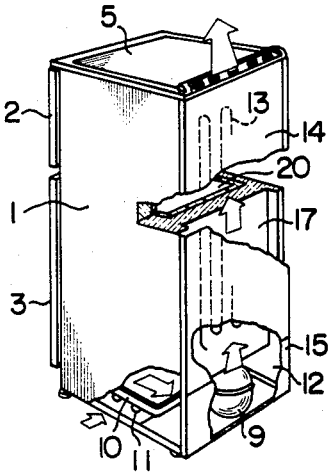
FIG. 3 PRIOR ART
FIG. 3 is a partial cut away perspective view of the refrigerator apparatus of FIG. 1.
Figure 4:
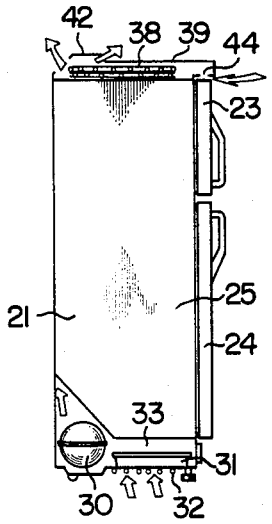
FIG. 4 is a partially schematic side view of a refrigerator apparatus constructed in accordance with the present invention.
Figure 5:
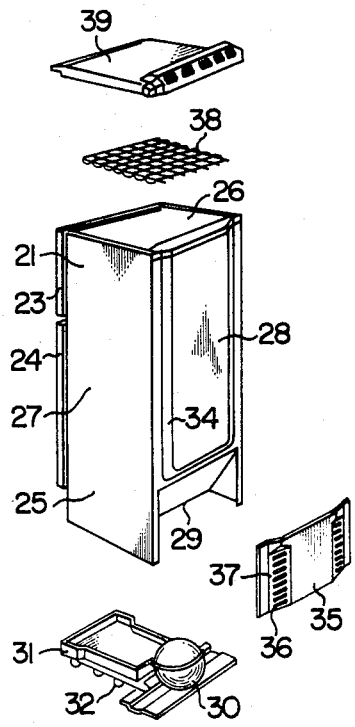
FIG. 5 is an exploded view of the refrigerator apparatus of FIG. 4.

The front cover portion 40 is provided with an operating knob 43 for regulating of the temperature in the chamber, as well as a suction port 44 formed in a part of the front cover portion 40 facing an upper surface 23*a* of the freezing chamber ddor 23. It is to be noted that the front cover portion 40 is tapered frontwardly so as to sufficiently separate the suction port 44 from the upper surface 23*a* of the freezing chamber door 23. In addition, as shown in FIG. 7, side walls of the main cover portion 41 are provided with vent holes 45.

Figure 6:
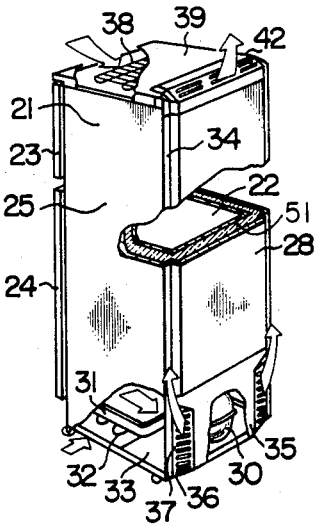
FIG. 6 is partial cut away perspective view of the refrigerator apparatus of FIG. 4.

The rear frame 42 is offset from the front cover portion 40 and the main cover portion 41, with the offset portions of the rear frame being provided with outlet ports 46 and 47. Grills 46*a* and 47*a* and provided in the outlet ports 46 and 47 and are disposed in parallel to the ceiling panel 26 is order to prevent the dust and the like from entering into the inside of the decorative cover 39 through the outlet ports 46 and 47 which are provided in order to discharge the heated air therethrough forwardly and rearwardly of the refrigerator. The outlet ports 46 and 47 open to inclined planes, so that even if an article is placed on the decorative cover 39 to close the outlet port 46 and/or the rear end of the refrigerator is placed in contact with a wall, the outlet ports 46 and 47 are completely closed. Furthermore, as shown in FIG. 6, the rear frame 42 is similar in shape to the rear panel 28 at the portions corresponding to the extensions of the upper heat discharge passages 34 provided on the rear panel 28. In addition, the outlet 47 is not provided in the portions similar in shape to those of the rear panel 28. Accordingly the heated air rising through the heat discharge passage is prevented from flowing into the inside of the decorative cover 39 where the main condenser 38 is located. A base 49 is mounted on the rear frame 42, with the base 49 having various electric parts mounted thereon which are connected to form an electric circuit for controlling the operation of the refrigerator. Further, the base 49 is, as shown in FIG. 7, disposed at a position adjacent to the rear frame 42 as well as closer to the ceiling panel 26 so that the base 49 will not be well seen from the outside through the outlet grill 47*a* provided on the rear frame 42. Moreover, since the compressor and the like are installed in the rear part of the machine chamber, the base 49 disposed in the rear part of the decorative cover 39 enables operations, such as wire or lead connections, to be conducted from the rear side of the refrigerator, resulting in an improved workability or serviceability.

Figure 7:
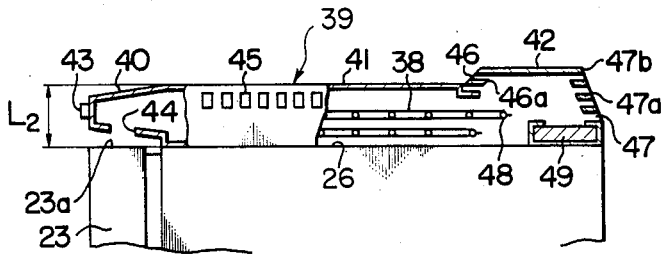
FIG. 7 is a partial cross sectional side view illustrating a positional relationship between a decorative cover and a main condenser employed in the refrigerator apparatus of FIG. 4.

As shown in FIG. 7, the grills 47*a* in the outlet port 47 are provided on the plane 47*b* inclined remote from the wall or the like to be in contact with the rear end of the refrigerator, so that even if the refrigerator installed with the rear end thereof in substantially close contact with the wall of the like the heated air can be discharged out from the inside of the decorative cover.

The following is the description of the positional relationship between the decorative cover 39 and the main condenser 38. First of all, the heightwise position of the main condenser 38 with respect to the decorative cover 39 will be explained. If the heightwise space between the decorative cover 39 and the ceiling panel 26 is represented by $L_2$, the main condenser 38 is disposed so as to be located in the lower part of the space $L_2$, as shown in FIG. 7. In other words, the main condenser 38 is sufficiently separated from the main cover portion 41 so as to define a space through which the air heated by the heat exchange with the main condenser 38 passes. The vent holes 45 are provided in a portion of each side wall of the main cover portion 41 facing to the space.

The main condenser 38 is so disposed that the rear end thereof reaches into a space defined by the rear frame 42 and that an inlet pipe 48 of the main condenser 38 is just faced to the rear frame 42. If a plurality of main condensers are installed, in view of the air convection, inlet pipes of the main condensers are located alternately adjacent to the outlet ports 46 and 47.

Figure 8:
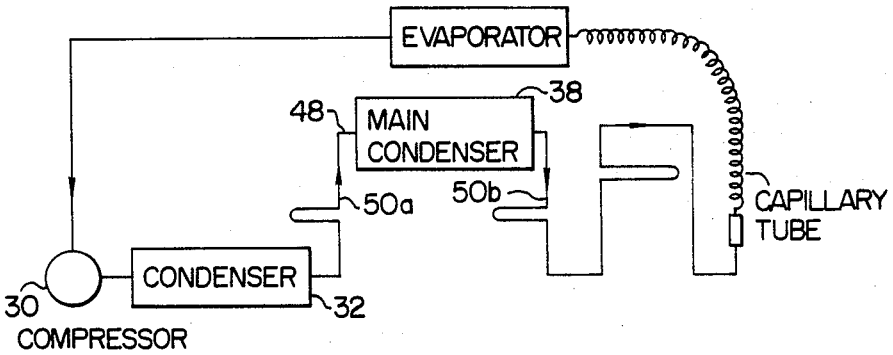
FIG. 8 is a schematic block diagram of a refrigerating cycle employed in the refrigerator of FIG. 4.

With reference to FIG. 8, in the refrigerating cycle of the refrigerator a gaseous coolant or cooling medium is compressed by the compressor 30 and pumped out to the condenser 32 and the main condenser 38. On passing through the condensers 32 and 38, the compressed coolant discharges a heat therefrom and is cooled without any change of the pressure thereof. The coolant having a high pressure is delivered from the condensers 32, 38 to the capillary tube through which the pressure of the coolant is decreased, and the coolant is partially liquefied. A partially liquefied coolant is delivered to the evaporator in which the coolant absorbs the heat from the atmosphere thereof and is evaporated. A gaseous coolant is delivered from the evaporator to the compressor and the refrigerating cycle is completed.

Figure 9:
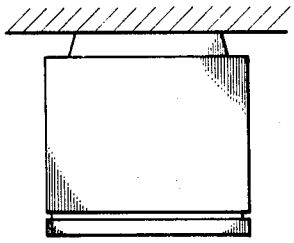
FIG. 9 is a top plan view of a refrigerating apparatus constructed in accordance with the present invention having a rear surface thereof disposed against a wall.
Figure 10:
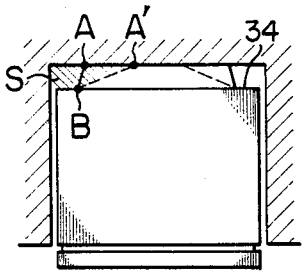
FIG. 10 is a top plan view of a refrigerating apparatus constructed in accordance with the present invention having the back end side surfaces thereof being surrounded by a wall.

It may be considered that the refrigerator having a construction described above is mostly installed in a state such as shown in FIGS. 9 and 10. More specifically, FIG. 9 illustrates the refrigerator which is installed at the rear end thereof in close contact with a wall or the like, while FIG. 10 illustrates the refrigerator which is installed at the rear and both sides thereof walled by walls, shelves or the like.

Even if the refrigerator is installed as mentioned above, according to the invention, the compressor 30, the condensers 32 and 38, and the like are well cooled to permit the refrigerating cycle to display its predetermined performance. As shown in FIG. 10, in the case where the refrigerator is installed with all the surfaces thereof walled except for the front and ceiling surfaces, the air entering through the front surface of the machine chamber 33 performs heat exchange with the compressor 30 and the drain condenser 32 installed in the machine chamber 33 as well as the drain collected in the drain evaporating pan 31 mounted on the drain condenser 32, and promotes the evaporation from the drain surface in the evaporating pan 31, and then is discharged out of the machine chamber 33 through the heat discharge ports 37. It is to be noted that the drain evaporating pan 31 is located between the air inlet an the outlets 37 of the machine chamber. The discharged heat-air then rises through the upper heat discharge passages 34 formed on the rear panel 28 to reach the rear frame 42 and is then discharged upwardly out of the refrigerator. On the other hand, the main condenser 38 mounted above the ceiling panel 26 of the refrigerator is cooled by the air introduced through the suction port and the vent holes 45. The air heated through the heat exchange with the main condenser 38 is discharged to the outside of the refrigerator through the outlet ports 46 and 47 provided in the rear frame 42. In this cace, the rear frame 42 is adapted to prevent particularly the air heated through the heat exchange with the compressor from entering toward the main condenser 38.

The heated-air in the machine chamber 33 is discharged through the heat discharge ports 37 provided in the slant wall lower heat discharge passage. Accordingly, it is preferale to make the dimension of the heat discharge port 37 as large as possible. However, the dimension of th slit-like heat discharge port 37 is, as a matter of course, restricted in the design point of view. Therefore, according to the invention, as shown in FIG. 10, each slant surface is formed as shown by A'-B so as to be sufficiently large although each of the slant surfaces of the rear panel 28 defining the heat discharge passages 34 is formed as shown by A-B, and the heat discharge ports 37 are formed in this portion. In other words, it is ideal to provide in this slant surface with heat discharge ports large enough to satisfactorily send the heated-air into a space having a volume equal to the value obtained by multiplying the area (the portion shown by diagonal lines) defined between the machine chamber cover 35, the rear wall and the shelf when the three sides of the refrigerator as walled as shown in FIG. 10, by the height of the machine chamber cover 35, e.g., S $cm^3$. Thus, the air heated through the heat exchange in the machine chamber 33 smoothly goes out of the machine chamber 33 and is then discharged to the outside through the heat discharge passages 34.

Figure 11:
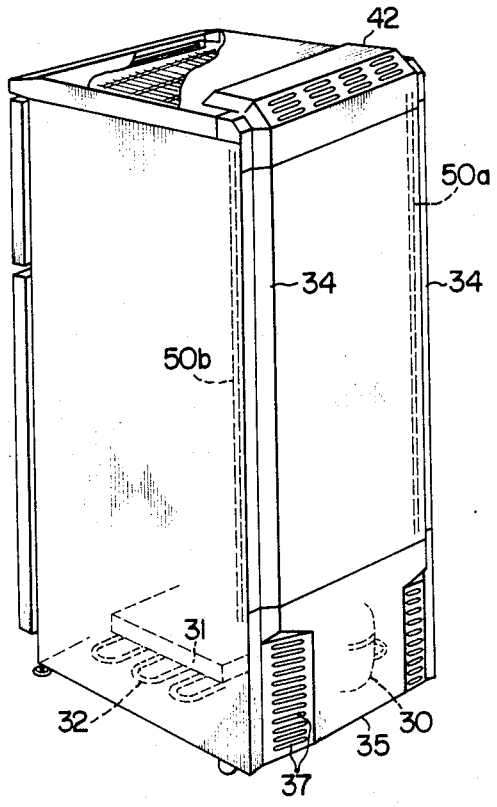
FIG. 11 is a partial cut away perspective view of the refrigerating apparatus of FIG. 4.

In addition, a conduit 50*a* for introducing a high-temperature coolant into the main condenser 38 and a conduit 50*b* for leading out the coolant from the main condenser are disposed in heat insulator layer 51 adjacent to the respective heat discharge passages 34 as well as along the rear panel 28 or side panels 27 as shown in FIG. 11. Therefore, it is possible to minimize the heat load applied to the chamber 22.

According to the refrigerator such as described above, the rear side of the refrigerator is reduced in depth by a space conventionally required for providing the main condenser. Accordingly, the depthwise dimension of the whole of the refrigerator is decreased, so that the refrigerator can cope with the reducing requirement of the space. In addition, the main condenser is improved in heat exchange efficiency, since the main condenser is cooled not by the high-temperature air having already exchanged heat with the compressor and but by a fresh air directly introduced into the inside of the decorative cover.

In addition, the conduits 50*a* and 50*b* for leading the high-temperature coolant into and out from the main condenser 38 are disposed in the heat insulator layer 51 adjacent to the heat discharge passages 34 and disposed along the rear panel 28 or the side panels 27, respectively. Therefore, it is possible to minimize the heat leakage into the chamber of the refrigerator as well as to cool the conduits 50*a* and 50*b* by means of the air rising through the heat discharge passages 34.

Furthermore, since the air flow can be obtained in the machine chamber 33, which passes from the air inlets formed in the machine chamber 33 to the heat discharge ports 37 formed in the machine chamber cover 35 and passes above the evaporating pan 31 disposed between the air inlets and the heat discharge ports, the compressor 30 and the like are cooled sufficiently and the drain in the machine chamber is evaporated. Namely, the evaporation of the drain collected in the evaporating pan 31 is promoted by a temperature difference between the low temperature air flow passing over the drain surface and the high temperature drain heated by the heat radiation of the drain condenser through the evaporating pan. The evaporated drain is mixed with the air flow passing above the evaporating pan 31 to form a wet air which is led into the heat discharge ports 37. Accordingly, the evaporating of the drain is well effected.

Further, the front end edge of the decorative cover 39 covering the main condenser 38 is elongated to the upper edge of the freezing chamber door 23. In addition, the inlet for the air for cooling the main condenser 38 is provided in a portion of the elongated front end of the decorative cover 39 corresponding to the door upper edge, and the outlets for discharging the air heated through the heat exchange with the main condenser 38 are provided in the rear part of the decorative cover 39. Moreover, such outlets are not provided in the recesses of the edge portions of the rear surface of the rear frame 42 in the decorative cover 39, which align with the heat discharge pasages so that the air rising through the heat discharge passages from the heat discharge ports in the machine chamber 33 will not enter to the inside of the decorative cover 39. Since the air passing through the machine chamber 33 will not enter to the inside the decorative cover 39, there is no possibility that the heat exchange performed by the main condenser 38 is impaired. Accordingly, the main condenser 38 is well cooled.

Although the invention has been described through specific terms, it is to be noted here that the described embodiment is not exclusive and various changes and modifications may be imparted thereto without departing from the scope of the invention which is limited solely by the appended claims.

What is claimed is:

1. A refrigerator comprising an outer frame means for defining a substantially rectangular parallelpiped outer contour of the refrigerator including a ceiling panel, a pair of side panels, a rear panel, and a bottom panel, said ceiling panel, side panels, rear panel, and body panel enclosing at least a refrigerating chamber; a machine chamber disposed at a bottom portion of said outer frame means for accommodating at least a compressor; a cover means disposed flush with a rear surface of said rear panel for covering a rear of said machine chamber; upper heat discharge passage means for discharging heat from at least the machine chamber to an upper part of the refrigerator including tapered grooves provided in both lateral edge portions of said rear panel; said cover means being provided with offset portions on respective lateral sides thereof; lower heat discharge passage means provided in said offset portions of said cover means for enabling a venting of said machine chamber;

heat discharge port means provided in a wall of each of said lower heat discharge passage means for providing a communication between said upper heat discharge passage means and said lower heat discharge passage means; and wherein an upper end of each of said upper heat discharge passage means is opened to an atmosphere.

2. A refrigerator according to claim 1, wherein said lower heat discharge passage means have a width larger than a width of said upper discharge passage means.

* * * * *